US011380258B2

(12) United States Patent
Xue

(10) Patent No.: US 11,380,258 B2
(45) Date of Patent: Jul. 5, 2022

(54) AMOLED PIXEL DRIVING CIRCUIT, PIXEL DRIVING METHOD, AND DISPLAY PANEL

(71) Applicant: SHENZHEN CHINA STAR OPTOELECTRONICS SEMICONDUCTOR DISPLAY TECHNOLOGY CO., LTD., Guangdong (CN)

(72) Inventor: Yan Xue, Guangdong (CN)

(73) Assignee: SHENZHEN CHINA STAR OPTOELECTRONICS SEMICONDUCTOR DISPLAY TECHNOLOGY CO., LTD, Guangdong (CN)

( * ) Notice: Subject to any disclaimer, the term of this patent is extended or adjusted under 35 U.S.C. 154(b) by 204 days.

(21) Appl. No.: 16/769,263

(22) PCT Filed: Apr. 8, 2020

(86) PCT No.: PCT/CN2020/083651
§ 371 (c)(1),
(2) Date: Jun. 3, 2020

(87) PCT Pub. No.: WO2021/179387
PCT Pub. Date: Sep. 16, 2021

(65) Prior Publication Data

US 2022/0122532 A1 Apr. 21, 2022

(30) Foreign Application Priority Data

Mar. 9, 2020 (CN) ..... 202010157241.2

(51) Int. Cl.
*G09G 3/3233* (2016.01)

(52) U.S. Cl.
CPC ... *G09G 3/3233* (2013.01); *G09G 2300/0842* (2013.01); *G09G 2310/061* (2013.01); *G09G 2310/08* (2013.01); *G09G 2320/0247* (2013.01)

(58) Field of Classification Search
None
See application file for complete search history.

(56) References Cited

U.S. PATENT DOCUMENTS

2004/0174349 A1* 9/2004 Libsch ..... H01L 27/12 257/E27.111
2015/0379923 A1* 12/2015 Lee ..... H01L 27/3272 345/82
2016/0104424 A1* 4/2016 Lim ..... H01L 27/1255 345/76
2018/0166516 A1* 6/2018 Chai ..... G09G 3/3233
(Continued)

FOREIGN PATENT DOCUMENTS

CN 105654904 A 6/2016
CN 106157886 A 11/2016
(Continued)

*Primary Examiner* — Dorothy Harris
(74) *Attorney, Agent, or Firm* — Soroker Agmon Nordman

(57) ABSTRACT

An active matrix organic light emitting diode (AMOLED) pixel driving circuit, pixel driving method, and a display panel are provided. All or part of the thin film transistors, which assist to store data voltage stably in the storage capacitor, prevent flickering of the display panel caused by data loss, and thereby improve the display effect and quality of the display panel.

14 Claims, 4 Drawing Sheets

(56) References Cited

U.S. PATENT DOCUMENTS

| | | | | |
|---|---|---|---|---|
| 2019/0057648 | A1 | 2/2019 | Xu | |
| 2019/0066587 | A1 | 2/2019 | Han | |
| 2019/0079330 | A1* | 3/2019 | Yamamoto | H01L 27/124 |
| 2019/0173057 | A1 | 6/2019 | Jung et al. | |
| 2019/0221161 | A1 | 7/2019 | Han | |
| 2020/0005708 | A1* | 1/2020 | Hwang | H01L 51/0097 |
| 2020/0118508 | A1* | 4/2020 | Park | G09G 3/3677 |
| 2020/0135109 | A1 | 4/2020 | Yuan et al. | |
| 2020/0184893 | A1 | 6/2020 | Dong | |
| 2020/0194527 | A1* | 6/2020 | Kawashima | H01L 51/5012 |
| 2020/0258921 | A1* | 8/2020 | Takahashi | H01L 27/1218 |

FOREIGN PATENT DOCUMENTS

| | | | |
|---|---|---|---|
| CN | 106875893 | A | 6/2017 |
| CN | 106991963 | A | 7/2017 |
| CN | 107301843 | A | 10/2017 |
| CN | 107316614 | A | 11/2017 |
| CN | 108206008 | A | 6/2018 |
| CN | 109166530 | A | 1/2019 |
| CN | 110021627 | A | 7/2019 |

* cited by examiner

AMOLED PIXEL DRIVING CIRCUIT, PIXEL DRIVING METHOD, AND DISPLAY PANEL

This application claims the priority of Chinese Application No. 202010157241.2, filed on Mar. 9, 2020, entitled "AMOLED PIXEL DRIVING CIRCUIT, PIXEL DRIVING METHOD, AND DISPLAY PANEL". The entire disclosure of the above application is incorporated herein by reference.

FIELD OF INVENTION

The present disclosure relates to the technical field of display, and in particular, relates to an active matrix organic light emitting diode (AMOLED) pixel driving circuit, a pixel driving method, and a display panel.

BACKGROUND OF INVENTION

Organic light emitting diode (OLED) display devices have many advantages, such as self-illumination, low driving voltages, high luminous efficiency, short response times, high clarity and contrast, near 180° viewing angles, wide operating temperature ranges, the realization of flexible display and large-area full-color display, etc., and are recognized by the industry as the most promising display devices.

OLED display devices can be divided into two types according to the driving method, such as passive matrix OLED (PMOLED) and active matrix OLED (AMOLED), namely direct addressing and thin film transistor (TFT) matrix addressing. AMOLED has pixels arranged in an array, which is an active display type with high luminous efficacy, and is usually used as a large-size display device with high definition.

At present, the large-size active matrix organic light emitting diode (AMOLED) panel pixel circuit generally uses an external compensation circuit represented by 3T1C, etc. The disadvantage of this type of circuit is that if the threshold voltage Vth of the switching TFT of the panel is negatively biased, the data voltage is difficult to stably store in the storage capacitor. Data may be gradually lost, causing flickering of the image, and the product quality may be seriously affected.

SUMMARY OF INVENTION

Technical Problem

The present disclosure provides an active matrix organic light emitting diode (AMOLED) pixel driving circuit, pixel driving method, and a display panel, which solve the loss of data signals caused by the negative bias of the threshold voltage of the switching TFT, avoid flickers, and ensure the normal display of the screen.

Technical Solution

The present disclosure provides an active matrix organic light emitting diode (AMOLED) pixel driving circuit, wherein all or part of thin film transistors of the AMOLED pixel driving circuit are dual-gate thin film transistors to adjust threshold voltages of the thin film transistors in the AMOLED pixel drive circuit.

In some embodiments, the AMOLED pixel drive circuit includes:

a first thin film transistor, wherein a top gate of the first thin film transistor is connected to a first circuit node, a first electrode is connected to receive a power voltage, and a second electrode is connected to a second circuit node;

a second thin film transistor, wherein a top gate of the second thin film transistor is connected to receive a first scanning signal, a third electrode is connected to receive a data voltage, and a fourth electrode is connected to the first circuit node;

a third thin film transistor, wherein a top gate of the third thin film transistor is connected to receive a second scanning signal, a fifth electrode is connected to the second circuit node, and a sixth electrode is connected to receive a reference voltage;

a capacitor, wherein one end is connected to the first circuit node, and the other end is connected to the second circuit node; and an organic light emitting diode, wherein an anode of the organic light emitting diode is electrically connected to the second circuit node, and a cathode is connected to receive a common ground voltage;

wherein at least one of the second thin film transistor and the third thin film transistor is a dual-gate thin film transistor.

In some embodiments, the second thin film transistor and the third thin film transistor are dual-gate thin film transistors, and bottom gates of the second thin film transistor and the third thin film transistor are connected to receive an external signal source to adjust threshold voltages of the second thin film transistor and the third thin film transistor.

In some embodiments, the bottom gate is a light-shielding layer of the AMOLED pixel driving circuit.

In some embodiment, the pixel driving circuit includes a first reset and data writing stage:

when the pixel driving circuit is in the first reset and data writing stage, the first scanning signal and the second scanning signal are at a high potential, the second thin film transistor and the third thin film transistor are turned-on, the first circuit node is input a data signal, the second circuit node is reset to a reference potential, a signal input by the external signal source is a positive potential signal, and threshold voltages of the second thin film transistor and the third thin film transistor are negative biases.

In some embodiments, the pixel driving circuit further includes a second reset stage:

when the first scanning signal is at a low potential, the second scanning signal is at a high potential, the second thin film transistor is turned-off, the third thin film transistor is turn-on, the external signal source is at a negative potential, and a threshold voltage of the second thin film transistor is positive bias.

In some embodiments, the pixel driving circuit further includes a light-emitting stage:

when the first scanning signal and the second scanning signal are at a low potential, the second thin film transistor and the third thin film transistor are turned-off, and the potentials of the first circuit node and the second circuit node rise simultaneously with respect to the second reset stage.

In some embodiments, the first thin film transistor is one or more of a low temperature polysilicon thin film transistor, an oxide semiconductor thin film transistor, and an amorphous silicon thin film transistor.

The second thin film transistor is one or more of a low temperature polysilicon thin film transistor, an oxide semiconductor thin film transistor, and an amorphous silicon thin film transistor.

The third thin film transistor is one or more of a low temperature polysilicon thin film transistor, an oxide semiconductor thin film transistor, and an amorphous silicon thin film transistor.

In some embodiments, the first thin film transistor, the second thin film transistor, and the third thin film transistor are one or more of a low temperature polysilicon thin film transistor, an oxide semiconductor thin film transistor, and an amorphous silicon thin film transistor.

In some embodiments, the first scanning signal, the second scanning signal, and the data voltage are generated by an external timing controller.

The present disclosure further provides a pixel driving method for driving pixels in the display panel to emit light by using the AMOLED pixel driving circuit, and the method comprises steps:

a first reset and data writing stage, wherein the first scanning signal and the second scanning signal are at a high potential, the second thin film transistor and the third thin film transistor are turned-on, the first circuit node is input a data signal, the second circuit node is reset to a reference potential, a signal input by the external signal source is a positive potential signal, and threshold voltages of the second thin film transistor and the third thin film transistor are negative biases;

a second reset state, wherein the first scanning signal is at a low potential, the second scanning signal is at a high potential, the second thin film transistor is turned-off, the third thin film transistor is turn-on, the external signal source is at a negative potential, and a threshold voltage of the second thin film transistor is positive bias; and a light-emitting stage, wherein the first scanning signal and the second scanning signal are at a low potential, the second thin film transistor and the third thin film transistor are turned-off, and the potentials of the first circuit node and the second circuit node rise simultaneously with respect to the second reset stage, the organic light emitting diode is flowed through a stable current, and the organic light emitting diode emits light.

In some embodiments, a bottom gate of the transistor is connected to receive an external signal.

In some embodiments, the bottom gate is a light-shielding layer of the AMOLED pixel driving circuit.

In some embodiments, the first thin film transistor is one or more of a low temperature polysilicon thin film transistor, an oxide semiconductor thin film transistor, and an amorphous silicon thin film transistor.

The second thin film transistor is one or more of a low temperature polysilicon thin film transistor, an oxide semiconductor thin film transistor, and an amorphous silicon thin film transistor.

The third thin film transistor is one or more of a low temperature polysilicon thin film transistor, an oxide semiconductor thin film transistor, and an amorphous silicon thin film transistor.

In some embodiments, the first scanning signal, the second scanning signal, and the data voltage are generated by an external timing controller.

In some embodiments, the bottom gate is a light-shielding layer of the AMOLED pixel driving circuit.

The present disclosure further provides a display panel, which comprises an active matrix organic light emitting diode (AMOLED) pixel driving circuit, wherein all or part of thin film transistors of the AMOLED pixel driving circuit are dual-gate thin film transistors to adjust threshold voltages of the thin film transistors in the AMOLED pixel drive circuit.

In some embodiments, the AMOLED pixel drive circuit includes:

a first thin film transistor, wherein a top gate of the first thin film transistor is connected to a first circuit node, a first electrode is connected to receive a power voltage, and a second electrode is connected to a second circuit node;

a second thin film transistor, wherein a top gate of the second thin film transistor is connected to receive a first scanning signal, a third electrode is connected to receive a data voltage, and a fourth electrode is connected to the first circuit node;

a third thin film transistor, wherein a top gate of the third thin film transistor is connected to receive a second scanning signal, a fifth electrode is connected to the second circuit node, and a sixth electrode is connected to receive a reference voltage;

a capacitor, wherein one end is connected to the first circuit node, and the other end is connected to the second circuit node; and an organic light emitting diode, wherein an anode of the organic light emitting diode is electrically connected to the second circuit node, and a cathode is connected to receive a common ground voltage;

wherein at least one of the second thin film transistor and the third thin film transistor is a dual-gate thin film transistor.

In some embodiments, the second thin film transistor and the third thin film transistor are dual-gate thin film transistors, and bottom gates of the second thin film transistor and the third thin film transistor are connected to receive an external signal source to adjust threshold voltages of the second thin film transistor and the third thin film transistor.

In some embodiments, the bottom gate is a light-shielding layer of the AMOLED pixel driving circuit.

In some embodiments, the pixel driving circuit includes a first reset and data writing stage:

when the pixel driving circuit is in the first reset and data writing stage, the first scanning signal and the second scanning signal are at a high potential, the second thin film transistor and the third thin film transistor are turned-on, the first circuit node is input a data signal, the second circuit node is reset to a reference potential, a signal input by the external signal source is a positive potential signal, and threshold voltages of the second thin film transistor and the third thin film transistor are negative biases.

In some embodiments, the pixel driving circuit further includes a second reset stage:

when the first scanning signal is at a low potential, the second scanning signal is at a high potential, the second thin film transistor is turned-off, the third thin film transistor is turn-on, the external signal source is at a negative potential, and a threshold voltage of the second thin film transistor is positive bias.

In some embodiments, the pixel driving circuit further includes a light-emitting stage:

when the first scanning signal and the second scanning signal are at a low potential, the second thin film transistor and the third thin film transistor are turned-off, and the potentials of the first circuit node and the second circuit node rise simultaneously with respect to the second reset stage.

In some embodiments, the first thin film transistor is one or more of a low temperature polysilicon thin film transistor, an oxide semiconductor thin film transistor, and an amorphous silicon thin film transistor.

In some embodiments, the second thin film transistor is one or more of a low temperature polysilicon thin film transistor, an oxide semiconductor thin film transistor, and an amorphous silicon thin film transistor.

In some embodiments, the third thin film transistor is one or more of a low temperature polysilicon thin film transistor, an oxide semiconductor thin film transistor, and an amorphous silicon thin film transistor.

Beneficial Effects

An embodiment of the present disclosure provides a pixel driving circuit, a pixel driving method, and a display panel. All or part of the thin film transistors in the AMOLED driving circuit are dual-gate thin film transistors. The dual-gate thin film transistor is used to realize the adjustment of the threshold voltage of the switching TFT to prevent the negative bias of the threshold voltage of the second thin-film transistor T2 used as the switching TFT. The data voltage is stably stored in the storage capacitor to prevent the display panel from flickers caused by data loss, thereby improving the display effect and the quality of the display panel.

In the embodiments of the present disclosure, it is provided that the light-shielding layer (LS) of the AMOLED pixel driving circuit is used as a bottom gate. In the process for manufacturing the AMOLED, there is a process for manufacturing the light shielding layer. During the mask exposure process, the light-shielding layer is added under the second thin-film transistor T2 and the third thin-film transistor T3, and only the mask pattern needs to be changed, but the numbers of masks are not increased, so that the manufacturing costs do not increase, and are beneficial to production. Furthermore, it also plays a role in preventing light from irradiating the active layer and maintaining the stability of the TFT.

DESCRIPTION OF DRAWINGS

In order to more clearly illustrate technical solutions in embodiments of the present disclosure, the drawings used in the description of the embodiments may be briefly introduced below. Obviously, the drawings in the following description are only some embodiments of the present disclosure, and those skilled in the art can obtain other drawings according to these drawings without any creative effort.

DETAILED DESCRIPTION OF PREFERRED EMBODIMENTS

The technical solutions in the embodiments of the present disclosure may be described clearly and completely in conjunction with the drawings in the embodiments of the present disclosure. The described embodiments are only a part of the embodiments of the present disclosure, but not all the embodiments. Based on the embodiments in the present disclosure, all other embodiments obtained by those skilled in the art without making creative work fall within the protection scope of the present disclosure.

For the directional terms described by the present disclosure, it is understood that upper, lower, front, back, left, right, inner, outer, side, longitudinal/vertical, transverse/horizontal, etc., are only directions by referring to the accompanying drawings, and thus the used directional terms are used to describe and explain the present disclosure, but the present disclosure is not limited thereto. Furthermore, the terms "first" and "second" are used for description purposes only, and cannot be understood as indicating or implying relative importance or implicitly indicating the number of technical features indicated. Thus, the features defined as "first" and "second" may explicitly or implicitly include one or more of the features. In the description of the present disclosure, the meaning of "plurality" is two or more, unless otherwise specifically limited.

At present, the large-scale active matrix organic light emitting diode (AMOLED) panel pixel circuit generally uses an external compensation circuit represented by 3T1C, etc. The disadvantage of this type of circuit is that if the threshold voltage Vth of the switching TFT of the panel is negatively biased, the data voltage has difficulty in being stably stored in the storage capacitor. It may be gradually lost, causing flickering of the image, and the product quality may be seriously affected.

Figure 1:
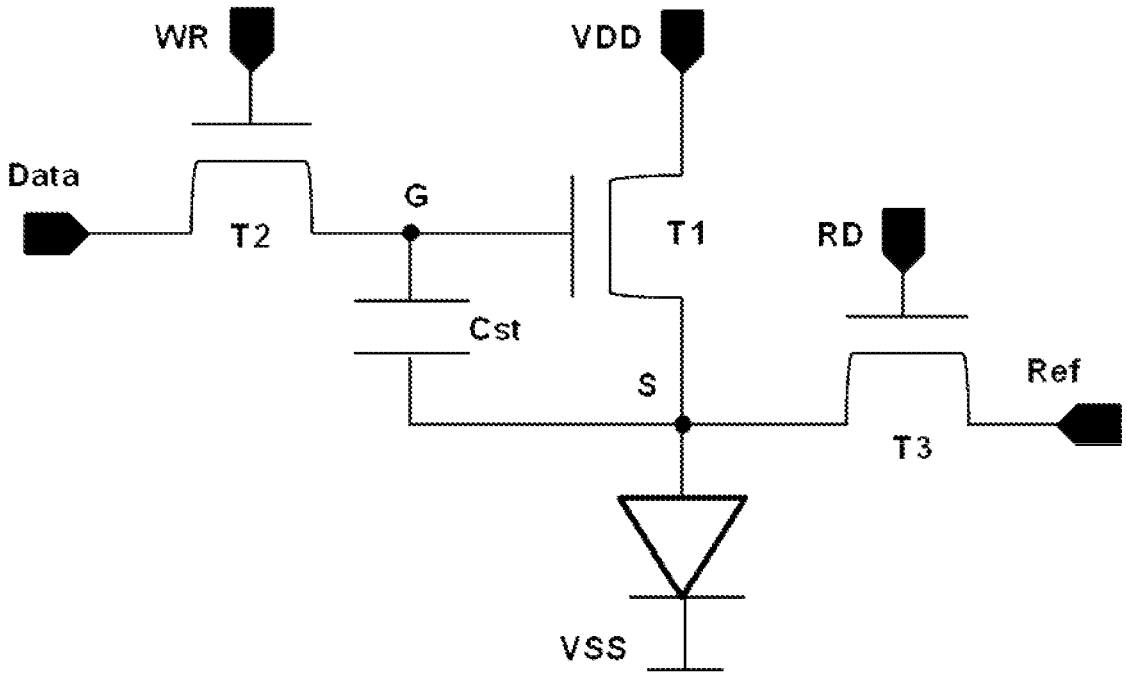
FIG. 1 is a 3T1C schematic diagram of an existing AMOLED pixel circuit.

Referring to FIG. 1, which is a 3T1C schematic diagram of an existing AMOLED pixel circuit. The circuit includes a first thin film transistor T1, a second thin film crystal T2, a third thin film transistor T3, a capacitor Cst and an organic light emitting diode. Specifically, in the stage that point S is reset and the gate is written data, a gate of the first thin film transistor T1 is connected to a first circuit node G, a drain in connected to receive a power voltage VDD, and a source is connected to receive a common ground voltage; a gate of the second thin film transistor T2 is connected to receive a first scanning signal WR, a drain is connected to receive a data voltage Data, and a source is connected to the first circuit node G; a top gate of the third thin film transistor T3 is connected to receive a second scanning signal RD, a drain is connected to receive a reference voltage Ref, and a source is connected to a second circuit node S.

Based on the above, the embodiment of the present disclosure provides an AMOLED pixel driving circuit, a pixel driving method, and a display panel, which may be described in detail below.

First, an embodiment of the present disclose provides an AMOLED pixel driving circuit, and all or part of the thin film transistors in the AMOLED pixel driving circuit are dual-gate thin film transistors to adjust the threshold voltage of the thin film transistors in the AMOLED pixel driving circuit.

Figure 2:
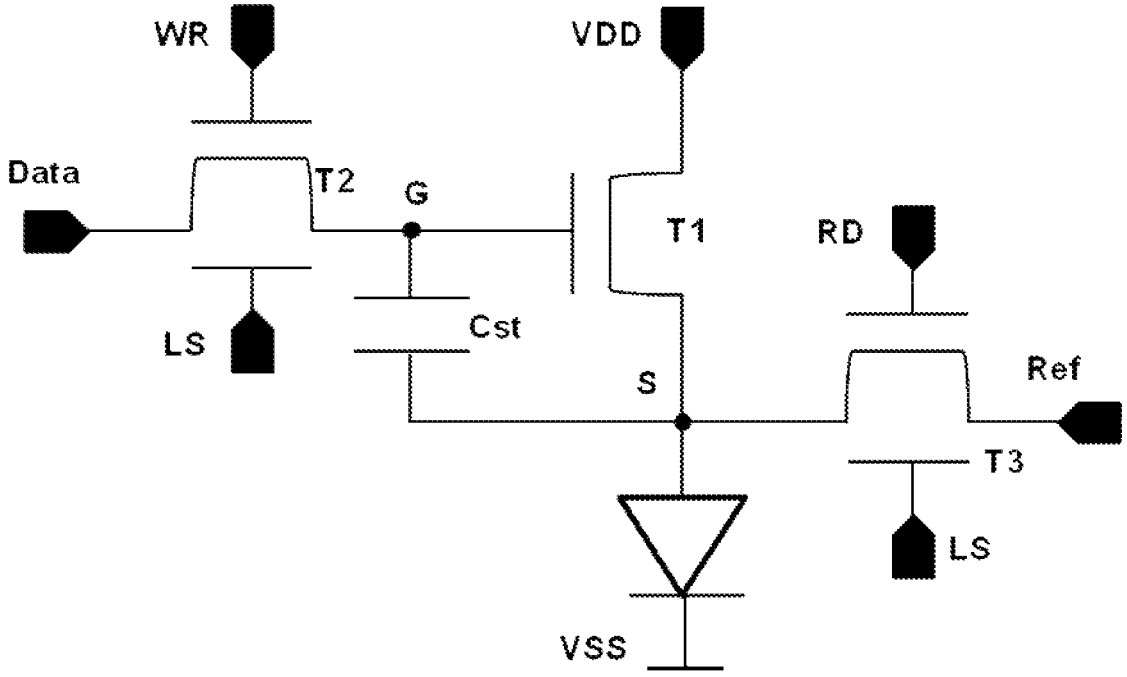
FIG. 2 is a schematic diagram of an AMOLED pixel driving circuit according to an embodiment of the present disclosure.

Based on the above embodiment, in another specific embodiment of the present disclose, please refer to FIG. 2, which is an AMOLED driving circuit diagram of this embodiment. The AMOLED driving circuit includes:

a first thin film transistor T1, wherein a top gate of the first thin film transistor T1 is connected to a first circuit node G, a first electrode is connected to a power voltage VDD, and a second electrode is connected to a second circuit node S;

a second thin film transistor T2, wherein a top gate of the second thin film transistor T2 is connected to a first scanning signal WR, a third electrode is connected to receive a data voltage Data, and a fourth electrode is connected to the first circuit node G;

specifically, the second thin film transistor T2 is a switching TFT;

a third thin film transistor T3, wherein a top gate of the third thin film transistor T3 is connected to receive a second scan signal RD, a fifth electrode is connected to the second circuit node S, and the sixth electrode is connected to receive a reference voltage Ref;

specifically, the first electrode to the sixth electrode may be gates or drains, which are determined according to the voltage direction;

a capacitor Cst is connected at one end to the first circuit node G and at the other end to the second circuit node S;

an organic light emitting diode, wherein an anode of the organic light emitting diode is electrically connected to the second circuit node S, and a cathode is connected to receive a common ground voltage VSS;

at least one of the second thin film transistor T2 and the third thin film transistor T3 is a dual-gate thin film transistor.

Based on the foregoing embodiment, in another specific embodiment of the present disclosure, the second thin film transistor T2 and the third thin film transistor T3 are both dual-gate thin film transistors, the bottom gates of the second thin film transistor T2 and the third thin film transistor T3 are connected to receive an external signal source LS to adjust the threshold voltages of the second thin film transistor T2 and the third thin film transistor T3.

In another specific embodiment of the present disclosure, the bottom gate is a light shielding layer 20 (LS) of the AMOLED pixel driving circuit.

Figure 7:
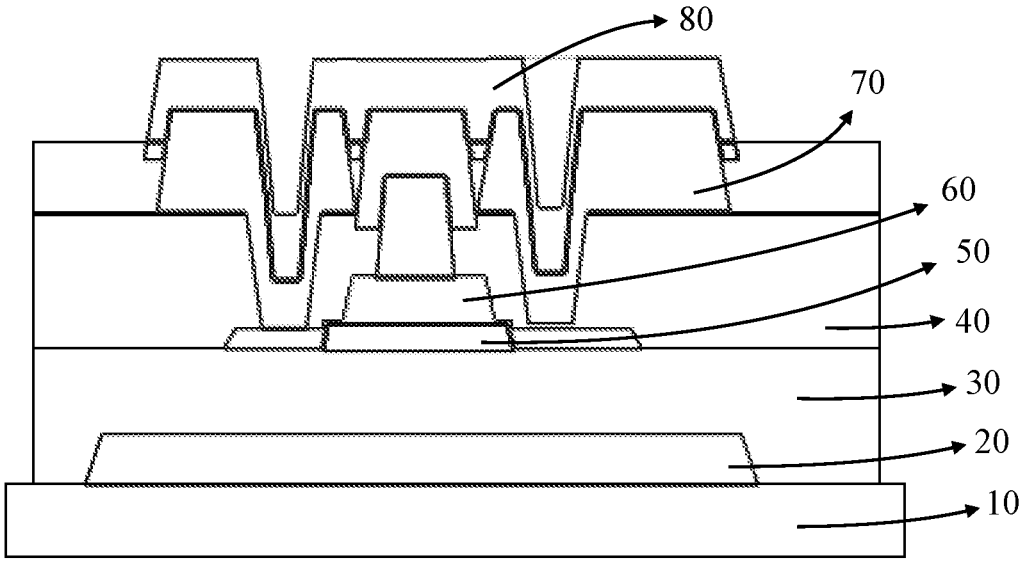
FIG. 7 is a structural schematic diagram of a thin film transistor according to an embodiment of the present disclosure.

Referring to FIG. 7, a structural schematic diagram of a thin film transistor according to an embodiment of the present disclosure is illustrated and includes a glass substrate 10, a light shielding layer 20, a bottom gate insulating layer 30, an interlayer dielectric layer 40, an IGZO 50, a gate insulating layer 60, and a second metal layer, and a passivation layer 80.

In another specific embodiment of the present disclosure, the pixel driving circuit includes a first reset and data writing stage:

when the pixel driving circuit is in the first reset and data writing stage, the first scanning signal WR and the second scanning signal RD are at a high potential, the second thin film transistor T2 and the third thin film transistor T3 are turned-on, the first circuit node G is input a data signal, the second circuit node S is reset to a reference potential Ref, a signal input by the external signal source LS is a positive potential signal, and threshold voltages of the second thin film transistor T2 and the third thin film transistor T3 are negative biases.

Based on the above embodiment, in another specific embodiment of the present disclosure, the pixel driving circuit further includes a second reset stage:

when the first scanning signal WR is at a low potential, the second scanning signal RD is at a high potential, the second thin film transistor T2 is turned-off, the third thin film transistor T3 is turn-on, the external signal source LS is at a negative potential, and a threshold voltage of the second thin film transistor T2 is positive bias.

Based on the above embodiment, in another specific embodiment of the present disclosure, the pixel driving circuit further includes a light-emitting stage:

when the first scanning signal WR and the second scanning signal RD are at a low potential, the second thin film transistor T2 and the third thin film transistor T3 are turned-off, and the potentials of the first circuit node G and the second circuit node S rise simultaneously with respect to the second reset stage.

In another specific embodiment of the present disclosure, the first thin film transistor is one or more of a low temperature polysilicon thin film transistor, an oxide semiconductor thin film transistor, and an amorphous silicon thin film transistor.

The second thin film transistor is one or more of a low temperature polysilicon thin film transistor, an oxide semiconductor thin film transistor, and an amorphous silicon thin film transistor.

The third thin film transistor is one or more of a low temperature polysilicon thin film transistor, an oxide semiconductor thin film transistor, and an amorphous silicon thin film transistor.

In another specific embodiment of the present disclosure, the first scanning signal WR, the second scanning signal RD, and the data voltage Data are all generated by an external timing controller.

In order to better implement the AMOLED pixel driving circuit in the embodiment of the present disclosure, based on the AMOLED pixel driving circuit, an embodiment of the present disclosure further provides a pixel driving method. The method includes:

a first reset and data writing stage (S1), wherein the first scanning signal WR and the second scanning signal RD are at a high potential, the second thin film transistor T2 and the third thin film transistor T3 are turned-on, the first circuit node G is input a data signal, the second circuit node S is reset to a reference potential Ref, a signal input by the external signal source LS is a positive potential signal, and threshold voltages of the second thin film transistor T2 and the third thin film transistor T3 are negative biases.

Figure 3:
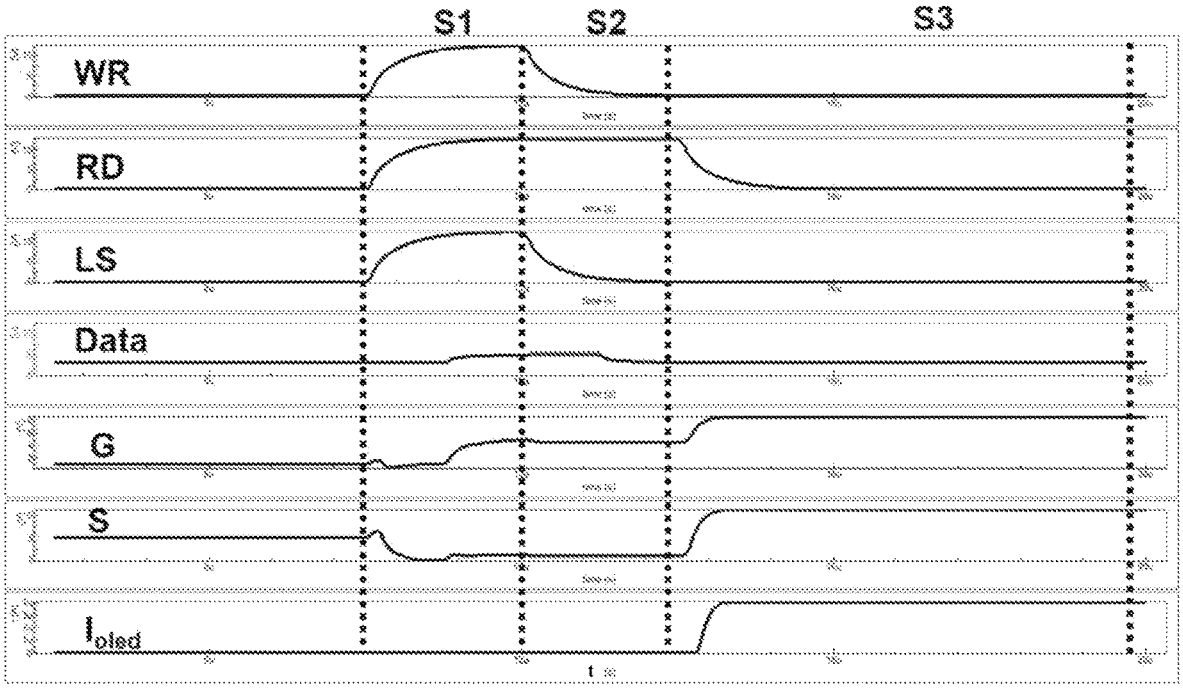
FIG. 3 is a timing diagram according to an embodiment of the present disclosure.

Referring to FIG. 3, the timing diagram of the embodiment represents the voltage values of the first scan signal WR, the second scan signal RD, the external signal source LS, the data voltage Data, the first circuit node G and the second circuit node S, respectively.

Specifically, the source and drain are based on the reference voltage, and the high voltage is the drain, as shown in FIG. 3. In the first thin film transistor T1, the first electrode connected to receive the power voltage VDD is the drain, and the second electrode connected to the second circuit node S is the source; in the second thin film transistor T2, the third electrode connected to receive the data voltage Data is a drain, and the fourth electrode connected to the first circuit node G is a source; in the third thin film transistor T3, the sixth electrode connected to the reference voltage Ref is a drain, and the fifth electrode connected to the second circuit node S is a source.

A second reset stage (S2), when the first scanning signal WR is at a low potential, the second scanning signal RD is at a high potential, the second thin film transistor T2 is turned-off, the third thin film transistor T3 is turn-on, the external signal source LS is at a negative potential, and a threshold voltage of the second thin film transistor T2 is positive bias.

Specifically, in the stage, the directions of the source and drain of the first thin film transistor T1, the second thin film transistor T2, and the third thin film transistor T3 are unchanged with respect to the first reset and data writing stage (S1).

A light-emitting stage (S3), when the first scanning signal WR and the second scanning signal RD are at a low potential, the second thin film transistor T2 and the third thin film transistor T3 are turned-off, and the potentials of the first circuit node G and the second circuit node S rise simultaneously with respect to the second reset stage. The organic light emitting diode flows through a stable current, and the organic light emitting diode emits light.

Specifically, in the stage, since the potentials of the first circuit node G and the second circuit node S rise simultaneously with respect to the second reset stage (S2), the source and drain of the second thin film transistor T2 and the third thin film transistor T3 are exchanged with respect to the first reset and data writing stage (S1). In the second thin film transistor T2, the third electrode connected to receive the data voltage Data is a source, and the fourth electrode connected to the first circuit node G is a drain; in the third thin film transistor T3, the sixth electrode connected to the reference voltage Ref is a source, and the fifth electrode connected to the second circuit node S is a drain.

Based on the above embodiment, in another specific embodiment of the present disclosure, the bottom gate of the dual-gate thin film transistor is connected to receive an external signal source LS.

In another specific embodiment of the present disclosure, the first thin film transistor is one or more of a low temperature polysilicon thin film transistor, an oxide semiconductor thin film transistor, and an amorphous silicon thin film transistor.

The second thin film transistor is one or more of a low temperature polysilicon thin film transistor, an oxide semiconductor thin film transistor, and an amorphous silicon thin film transistor.

The third thin film transistor is one or more of a low temperature polysilicon thin film transistor, an oxide semiconductor thin film transistor, and an amorphous silicon thin film transistor.

In another specific embodiment of the present disclosure, the bottom gate is the light-shielding layer 20 of the AMOLED pixel driving circuit.

In another specific embodiment of the present disclosure, the first scanning signal WR, the second scanning signal RD, and the data voltage Data are all generated by an external timing controller.

Based on the pixel driving method, an embodiment of the present disclosure further provides a display panel including the above pixel driving circuit.

It should be noted that, in the above embodiment of the display panel, only the above structure is described. It can be understood that, in addition to the above structure, the display panel of the embodiment of the present disclosure may further include any other necessary structures, such as a substrate layer, a thin film transistor layer, and an encapsulation layer, etc., which is not specifically limited herein.

The conventional circuit has no external signal source LS. When the second thin film transistor T2 is negatively biased to −7V, the potential at the first circuit node G of the fourth electrode is lost, and the OLED current may quickly disappear, resulting in the OLED being unable to emit light, and the display panel may flicker.

Figure 4:
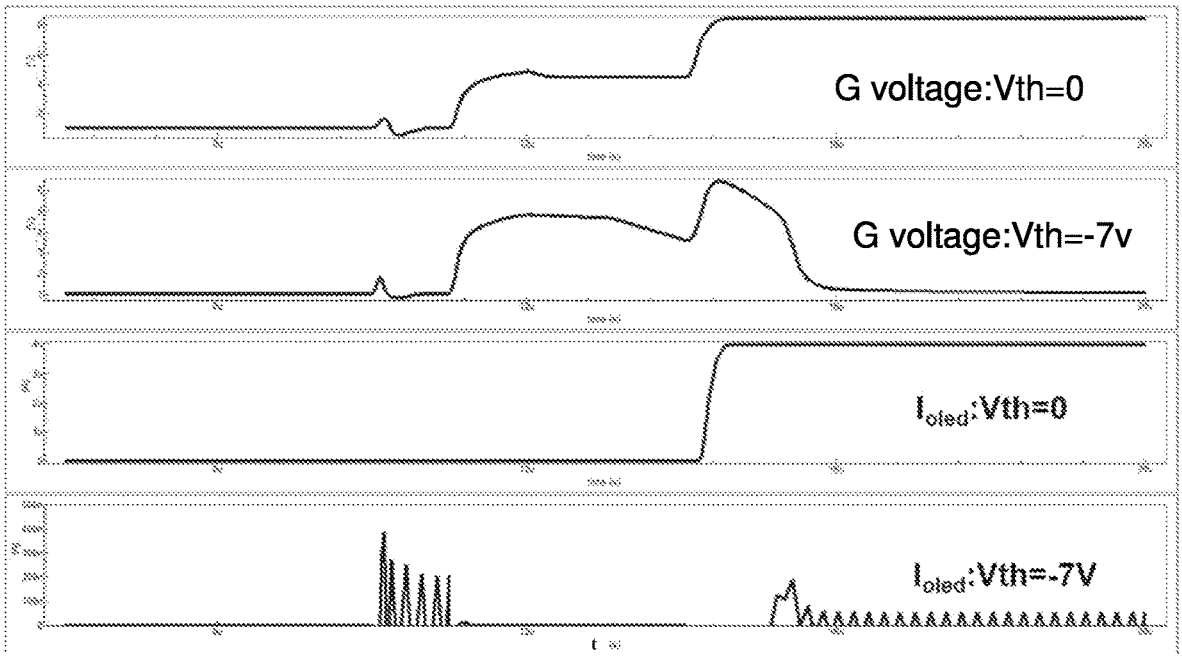
FIG. 4 PRIOR ART
FIG. 4 is a comparison diagram of the effects of the negative bias of the second thin film transistor T2 on the gate voltage G: Vth and OLED current (G: Ioled) of the first thin film transistor T1 in the prior art.
Figure 5:
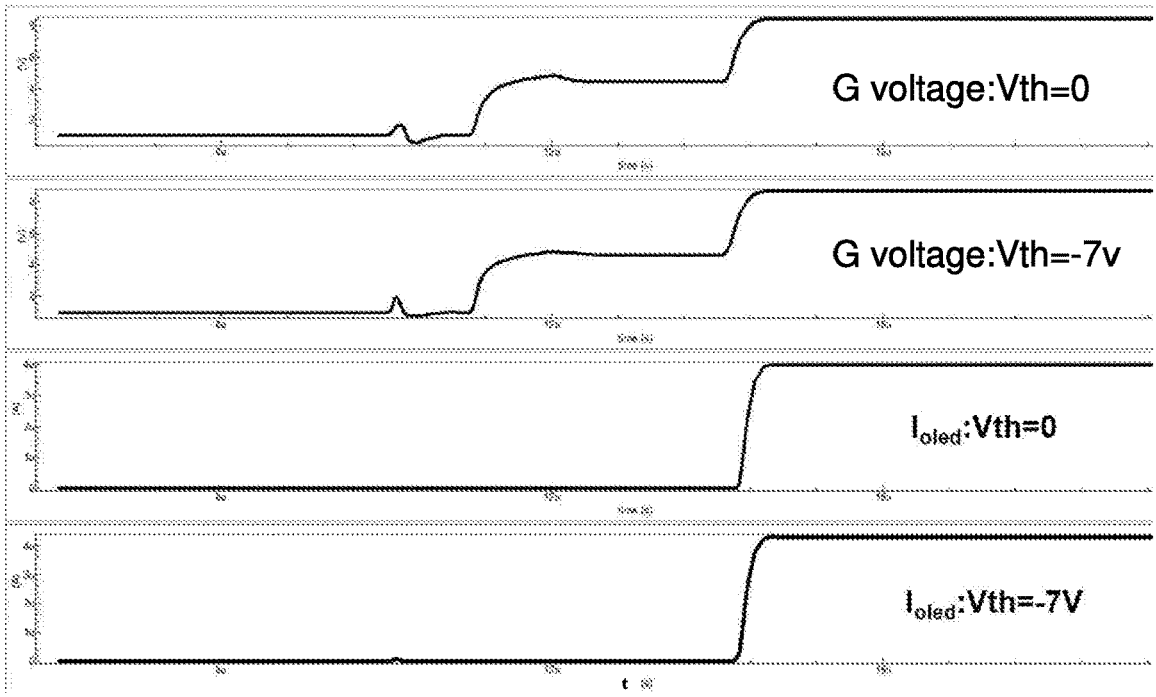
FIG. 5 is a comparison diagram of the effects of the negative bias of the second thin film transistor T2 on the gate voltage G: Vth and OLED current (G: Ioled) of the first thin film transistor T1 according to an embodiment of the present disclosure.

Referring FIG. 4 and FIG. 5, wherein FIG. 4 is a comparison diagram of the effects of the negative bias of the second thin film transistor T2 on the gate voltage G: Vth and OLED current (G: Ioled) of the first thin film transistor T1 in the prior art, and FIG. 5 is a comparison diagram of the effects of the negative bias of the second thin film transistor T2 on the gate voltage G: Vth and OLED current (G: Ioled) of the first thin film transistor T1 according to an embodiment of the present disclosure.

The embodiment of the present disclosure can adjust the threshold voltage Vth of the second thin film transistor T2 through bottom gate control. If the voltage is negative, the bottom gate is used to give a negative voltage, and the threshold voltage Vth is adjusted to be positive, so that the gate voltage is locked and the current of the OLED can be stabilized.

Figure 6:
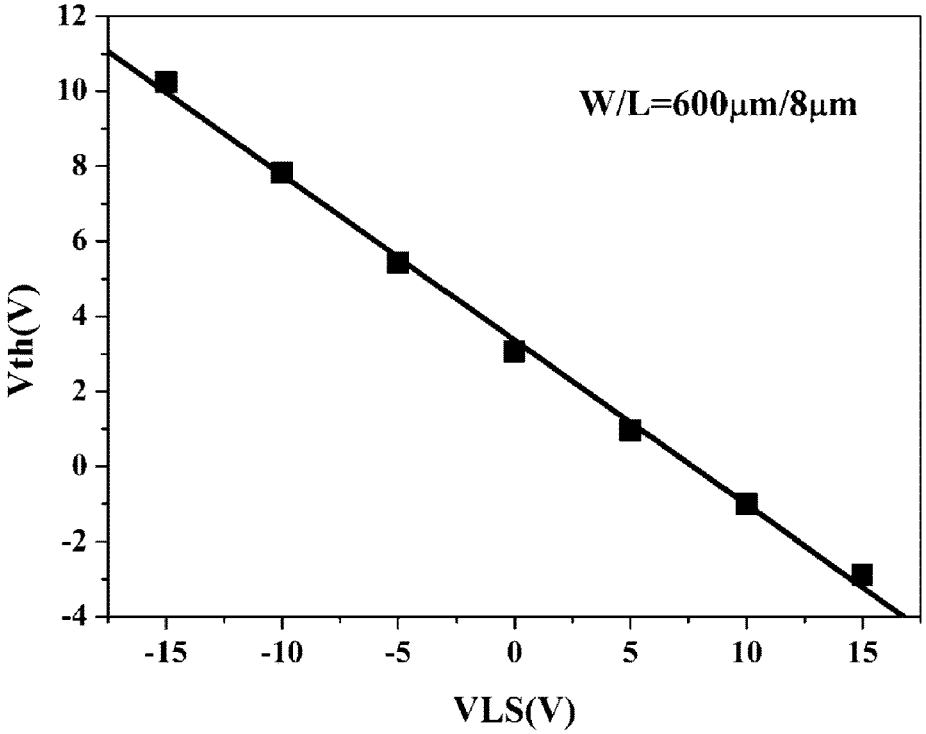
FIG. 6 is a schematic diagram showing the relationship between the bottom gate of a TFT connected to an external voltage and a threshold voltage in an AMOLED pixel driving circuit.

FIG. 6 is a schematic diagram showing the relationship between the bottom gate of a TFT connected to an external voltage and a threshold voltage in an AMOLED pixel driving circuit. It can be seen from the figure that the external voltage is inversely proportional to the threshold voltage Vth.

Specifically, TFT represents the second thin film transistor T2 and the third thin film transistor T3.

An embodiment of the present disclosure provides a pixel driving circuit, a pixel driving method, and a display panel. All or part of the thin film transistors in the AMOLED driving circuit are dual-gate thin film transistors. The dual-gate thin film transistor is used to realize the adjustment of the threshold voltage of the switching TFT to prevent the negative bias of the threshold voltage of the second thin-film transistor T2 used as the switching TFT. The data voltage is stably stored in the storage capacitor to prevent the display panel from flickers caused by data loss, thereby improving the display effect and the quality of the display panel.

In the embodiments of the present disclosure, it is provided that the light-shielding layer (LS) of the AMOLED pixel driving circuit is used as a bottom gate. In the process for manufacturing the AMOLED, there is a process for manufacturing the light shielding layer. During the mask exposure process, the light-shielding layer is added under the second thin-film transistor T2 and the third thin-film transistor T3, and only the mask pattern needs to be changed, but the numbers of masks are not increased, so that the manufacturing costs do not increase, and are beneficial to production. Furthermore, it also plays a role in preventing light from irradiating the active layer and maintaining the stability of the TFT.

In the above embodiments, the description of each embodiment has its own emphasis. For the parts that are not detailed in the embodiments, please refer to the detailed descriptions in other embodiments above, which may not be repeated here.

During specific implementation, the above units or structures can be implemented as independent entities or can be combined in any combination. As the same or several entities, the specific implementation of the above units or structures can refer to the foregoing method embodiments, which may not be repeated here.

The specific implementation of the above operations can refer to the previous embodiments, and may not be repeated here.

The AMOLED pixel driving circuit, pixel driving method and display panel provided by the embodiments of the present disclosure are described in detail above. In this article, specific examples are used to explain the principle and implementation of the present disclosure. The descriptions of the above embodiments are only used to help understand the method and the core idea of the present disclosure. At the same time, for those skilled in the art, according to the idea of this present disclosure, there may be changes in the specific implementation manner and application scope. In summary, the content of this specification should not be understood as a limitation to the present disclosure.

What is claimed is:

1. An active matrix organic light emitting diode (AMOLED) pixel driving circuit, wherein all or part of thin film transistors of the AMOLED pixel driving circuit are dual-gate thin film transistors to adjust threshold voltages of the thin film transistors in the AMOLED pixel drive circuit, wherein the AMOLED pixel drive circuit includes:

a first thin film transistor, wherein a top gate of the first thin film transistor is connected to a first circuit node, a first electrode is connected to receive a power voltage, and a second electrode is connected to a second circuit node;

a second thin film transistor, wherein a top gate of the second thin film transistor is connected to receive a first scanning signal, a third electrode is connected to receive a data voltage, and a fourth electrode is connected to the first circuit node;

a third thin film transistor, wherein a top gate of the third thin film transistor is connected to receive a second scanning signal, a fifth electrode is connected to the second circuit node, and a sixth electrode is connected to receive a reference voltage;

a capacitor, wherein one end is connected to the first circuit node, and the other end is connected to the second circuit node; and an organic light emitting diode, wherein an anode of the organic light emitting diode is electrically connected to the second circuit node, and a cathode is connected to receive a common ground voltage;

wherein at least one of the second thin film transistor and the third thin film transistor is a dual-gate thin film transistor;

wherein the pixel driving circuit includes a first reset and data writing stage: when the pixel driving circuit is in the first reset and data writing stage, the first scanning signal and the second scanning signal are at a high potential, the second thin film transistor and the third thin film transistor are turned-on, the first circuit node is input a data signal, the second circuit node is reset to a reference potential, a signal input by the external signal source is a positive potential signal, and threshold voltages of the second thin film transistor and the third thin film transistor are negative biases;

wherein the pixel driving circuit further includes a second reset stage: when the first scanning signal is at a low potential, the second scanning signal is at a high potential, the second thin film transistor is turned-off, the third thin film transistor is turn-on, the external signal source is at a negative potential, and a threshold voltage of the second thin film transistor is positive bias.

2. The AMOLED pixel driving circuit according to claim 1, wherein the second thin film transistor and the third thin film transistor are dual-gate thin film transistors, and bottom gates of the second thin film transistor and the third thin film transistor are connected to receive an external signal source to adjust threshold voltages of the second thin film transistor and the third thin film transistor.

3. The AMOLED pixel driving circuit according to claim 1, wherein the bottom gate is a light-shielding layer of the AMOLED pixel driving circuit.

4. The AMOLED pixel driving circuit according to claim 1, wherein the pixel driving circuit further includes a light-emitting stage:

when the first scanning signal and the second scanning signal are at a low potential, the second thin film transistor and the third thin film transistor are turned-off, and the potentials of the first circuit node and the second circuit node rise simultaneously with respect to the second reset stage.

5. A pixel driving method for driving pixels in the display panel to emit light by using the AMOLED pixel driving circuit according to claim 1, comprising steps:

a first reset and data writing stage, wherein the first scanning signal and the second scanning signal are at a high potential, the second thin film transistor and the third thin film transistor are turned-on, the first circuit node is input a data signal, the second circuit node is reset to a reference potential, a signal input by the external signal source is a positive potential signal, and threshold voltages of the second thin film transistor and the third thin film transistor are negative biases;

a second reset state, wherein the first scanning signal is at a low potential, the second scanning signal is at a high potential, the second thin film transistor is turned-off, the third thin film transistor is turn-on, the external signal source is at a negative potential, and a threshold voltage of the second thin film transistor is positive bias; and a light-emitting stage, wherein the first scanning signal and the second scanning signal are at a low potential, the second thin film transistor and the third thin film transistor are turned-off, and the potentials of the first circuit node and the second circuit node rise simultaneously with respect to the second reset stage, the organic light emitting diode is flowed through a stable current, and the organic light emitting diode emits light.

6. The pixel driving method according to claim 5, wherein a bottom gate of the transistor is connected to receive an external signal.

7. The pixel driving method according to claim 6, wherein the bottom gate is a light-shielding layer of the AMOLED pixel driving circuit.

8. A display panel, comprising an active matrix organic light emitting diode (AMOLED) pixel driving circuit, wherein all or part of thin film transistors of the AMOLED pixel driving circuit are dual-gate thin film transistors to adjust threshold voltages of the thin film transistors in the AMOLED pixel drive circuit, wherein the AMOLED pixel drive circuit includes:

a first thin film transistor, wherein a top gate of the first thin film transistor is connected to a first circuit node, a first electrode is connected to receive a power voltage, and a second electrode is connected to a second circuit node;

a second thin film transistor, wherein a top gate of the second thin film transistor is connected to receive a first scanning signal, a third electrode is connected to receive a data voltage, and a fourth electrode is connected to the first circuit node;

a third thin film transistor, wherein a top gate of the third thin film transistor is connected to receive a second scanning signal, a fifth electrode is connected to the second circuit node, and a sixth electrode is connected to receive a reference voltage;

a capacitor, wherein one end is connected to the first circuit node, and the other end is connected to the second circuit node; and an organic light emitting diode, wherein an anode of the organic light emitting diode is electrically connected to the second circuit node, and a cathode is connected to receive a common ground voltage;

wherein at least one of the second thin film transistor and the third thin film transistor is a dual-gate thin film transistor;

wherein the pixel driving circuit includes a first reset and data writing stage: when the pixel driving circuit is in the first reset and data writing stage, the first scanning signal and the second scanning signal are at a high potential, the second thin film transistor and the third thin film transistor are turned-on, the first circuit node is input a data signal, the second circuit node is reset to a reference potential, a signal input by the external signal source is a positive potential signal, and threshold voltages of the second thin film transistor and the third thin film transistor are negative biases;

wherein the pixel driving circuit further includes a second reset stage: when the first scanning signal is at a low potential, the second scanning signal is at a high potential, the second thin film transistor is turned-off, the third thin film transistor is turn-on, the external signal source is at a negative potential, and a threshold voltage of the second thin film transistor is positive bias.

9. The display panel according to claim 8, wherein the second thin film transistor and the third thin film transistor are dual-gate thin film transistors, and bottom gates of the second thin film transistor and the third thin film transistor are connected to receive an external signal source to adjust threshold voltages of the second thin film transistor and the third thin film transistor.

10. The display panel according to claim 8, wherein the bottom gate is a light-shielding layer of the AMOLED pixel driving circuit.

11. The display panel according to claim 8, wherein the pixel driving circuit further includes a light-emitting stage: when the first scanning signal and the second scanning signal are at a low potential, the second thin film transistor and the third thin film transistor are turned-off, and the potentials of the first circuit node and the second circuit node rise simultaneously with respect to the second reset stage.

12. The display panel according to claim 8, wherein the first thin film transistor is one or more of a low temperature polysilicon thin film transistor, an oxide semiconductor thin film transistor, and an amorphous silicon thin film transistor.

13. The display panel according to claim 8, wherein the second thin film transistor is one or more of a low temperature polysilicon thin film transistor, an oxide semiconductor thin film transistor, and an amorphous silicon thin film transistor.

14. The display panel according to claim 8, wherein the third thin film transistor is one or more of a low temperature polysilicon thin film transistor, an oxide semiconductor thin film transistor, and an amorphous silicon thin film transistor.

* * * * *